United States Patent [19]

Rundell et al.

[11] Patent Number: 4,660,636

[45] Date of Patent: Apr. 28, 1987

[54] PROTECTIVE DEVICE FOR RF APPLICATOR IN IN-SITU OIL SHALE RETORTING

[75] Inventors: Herbert A. Rundell; Richard H. Vinton; Kerry D. Savage, all of Houston, Tex.

[73] Assignee: Texaco Inc., White Plains, N.Y.

[21] Appl. No.: 265,263

[22] Filed: May 20, 1981

[51] Int. Cl.[4] ..... E21B 36/04

[52] U.S. Cl. ..... 166/60; 219/10.55 R

[58] Field of Search ..... 219/10.55 R, 10.55 A, 219/10.65; 174/179, 138 R, 138 A; 166/248, 60

[56] References Cited

U.S. PATENT DOCUMENTS

| | | | |
|---|---|---|---|
| 1,568,027 | 12/1925 | Swan | 166/179 X |
| 2,308,473 | 1/1943 | Wadman | 174/179 |
| 3,068,339 | 12/1962 | Kay | 166/60 |
| 3,133,592 | 5/1964 | Tomberlin | 219/10.55 R |
| 4,193,448 | 3/1980 | Jeambey | 219/10.55 R |
| 4,315,699 | 2/1982 | Lusk | 174/179 |

FOREIGN PATENT DOCUMENTS

| | | | |
|---|---|---|---|
| 244447 | 12/1982 | Australia | 219/10.55 R |

*Primary Examiner*—James A. Leppink
*Assistant Examiner*—William P. Neuder
*Attorney, Agent, or Firm*—Robert A. Kulason; Ronald G. Gillespie

[57] ABSTRACT

In the in-situ retorting of oil shale using radio frequency electrical energy, an applicator is inserted into a borehole and energized at a radio frequency. A protective device protects the applicator from expansion of the oil shale formation. The protective device includes an end plate attached to the applicator and a plurality of elements surrounds the applicator and is in contact with the end plate so as to prevent the oil shale formation from contacting the applicator.

7 Claims, 2 Drawing Figures

PROTECTIVE DEVICE FOR RF APPLICATOR IN IN-SITU OIL SHALE RETORTING

BACKGROUND OF THE INVENTION

1. Field of the Invention

The present invention relates to the recovery of hydrocarbons from an earth formation in general and, more particularly, to the in-situ recovery of hydrocarbon fluids from oil shale.

SUMMARY OF THE INVENTION

An applicator in a borehole traversing an oil shale formation is energized with electricity at a radio frequency to retort the oil shale. A protective device protects the applicator from the oil shale formation expansion due to the heating resulting from the radiation from the applicator. The protective device includes an end plate attached to the end of the applicator. A plurality of elements surrounds the applicator and rests one against another with one being in contact with the end plate so as to protect the applicator from the expanding oil shale.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

In the in-situ retorting of oil shale, an applicator is inserted into a borehole traversing the oil shale formation and energized with radio frequency electromagnetic energy. A major problem encountered is the expansion of the oil shale formation due to the heat from radiation of the electromagnetic energy. The present invention protects the applicator from the expansion of the oil shale formation.

Figure 1:
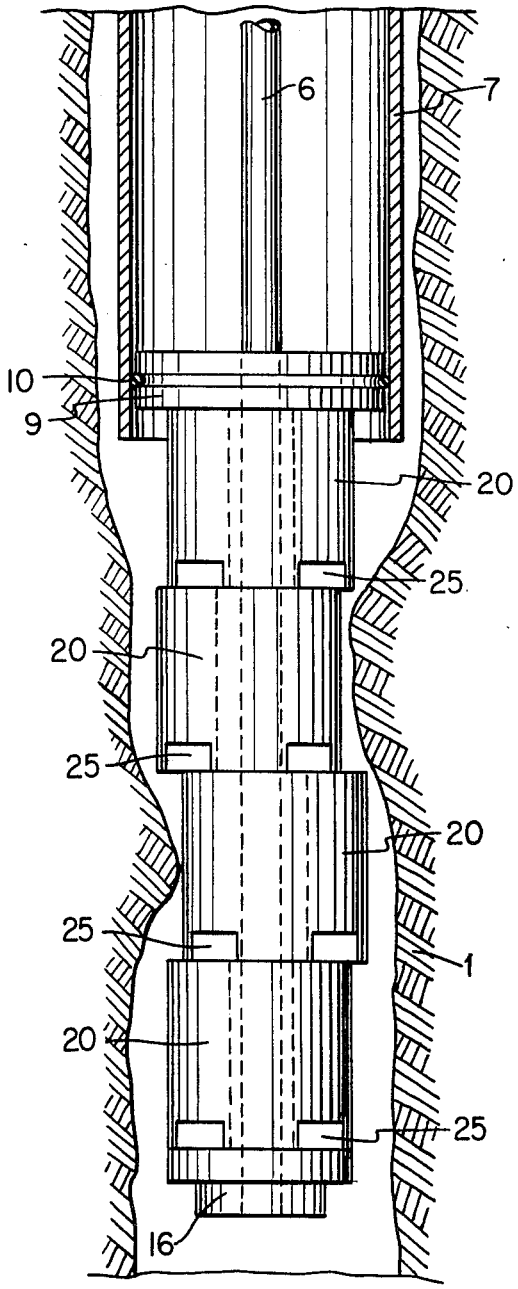
FIG. 1 is a representation of a protective device constructed in accordance with the present invention, which protects an RF applicator in the RF retorting of oil shale.

With reference to FIG. 1, there is shown a borehole 1 traversing an oil shale formation 5 in which the oil shale is depicted as having already experienced expansion. An applicator 6 is inserted into borehole 1 through a metal casing 7 in a manner so that it extends beyond the metal casing 7 into borehole 1. An upper end plate 9 is sealed with casing 7 by O-rings 10.

A bottom end plate 16 is affixed to applicator 6. A plurality of elements 20 rests on bottom plate 16 and protects applicator 6.

Element 20 made of ceramic material has a preferred length greater than half the outer diameter of each element 20 but less than twice the outer diameter of element 20. Ceramic material offers a very low loss tangent for the electromagnetic field; it is strong in compression and has a high electrical resistance and low porosity. Further, each element 20 has an inner cylindrical passageway which allows the element 20 to move in a lateral direction to the longitudinal axis of applicator 6. Thus, the lateral movement of elements 20 coupled with their lengths provide for a flexible ceramic protective device.

The inner passageway also allows the removal of produced hydrocarbons.

Figure 2:
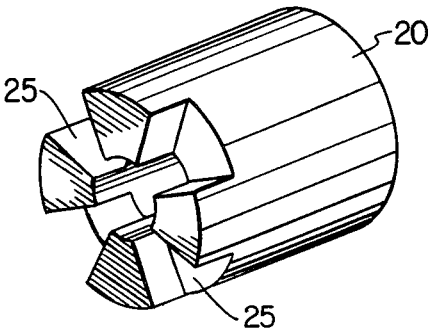
FIG. 2 depicts a single ceramic element of the type used in FIG. 1.

With reference to FIG. 2, the removal of hydrocarbons by the inner passage is enhanced by having each element 20 at one end having indentations 25 so that when stacked as shown in FIG. 1 at the interface of each element 20 with another element 20 or with the endplate 16, the indentations 25 form openings to allow the hydrocarbons in borehole 1 to enter the inner passageway.

The present invention is a protective device for protecting an RF applicator in the in-situ recovery of oil shale.

What is claimed is:

1. In the in-situ radio frequency retorting of oil shale in which an applicator is placed in a borehole traversing an oil shale formation and electrically energized at a radio frequency, a protective device comprising an end plate attached to the end of said applicator, and a plurality of means surrounding said applicator and resting one against another until one means if in contact against said end plate and each means being able to move laterally to the longitudinal axis of the applicator for protecting said applicator from expansion of the oil shale formation.

2. A protective device as described in claim 1 in which each means consists of a material which is very strong in compression, does not deteriorate as a result of the heat created, has a low loss tangent for an electromagnetic field created by the energized applicator and has a high electrical resistance and a very low porosity.

3. A protective device as described in claim 2 in which the material is ceramic.

4. A protective device as described in claim 3 in which each means is a cylinder having a length that is less than twice the diameter of the cylinder but greater than half the diameter of the cylinder.

5. A protective device as described in claim 4 in which each cylinder has an inner circular passageway for the applicator having a diameter sufficient to allow each cylinder to move laterally to the longitudinal axis of the applicator.

6. A protective device as described in claim 5 further comprising sealing means for sealing the applicator with a casing, entered partway into the borehole, to facilitate the production of hydrocarbon fluids from the retorting of the oil shale.

7. In the in-situ radio-frequency retorting of oil shale in which an applicator is placed in a borehole traversing an oil shale formation and electrically energized at a radio frequency, a protective device comprising:

an end plate attached to the end of said applicator;

a plurality of means surrounding said applicator and resting one against another until one means is in contact with said end plate for protecting said applicator from expansion of the oil shale formation, each of said means being a ceramic cylinder having a length that is less than twice an outer diameter of the cylinder but greater than half of the outer diameter of the cylinder, and, each means has an inner circular passageway for the applicator having a diameter sufficient to allow each means to move laterally to the longitudinal axis of the applicator, and each means has openings at one end to allow the hydrocarbon fluids to enter the inner passageways for removal; and sealing means for sealing the applicator with a casing entered part-way into the borehole to facilitate the production of hydrocarbon fluids from the retorting of the oil shale.

* * * * *